US006814611B1

(12) United States Patent
Torres

(10) Patent No.: US 6,814,611 B1
(45) Date of Patent: Nov. 9, 2004

(54) POWER SURGE PROTECTORANT ELECTRICAL OUTLET ASSEMBLY

(76) Inventor: Henoc T. Torres, 127 E. Prospect St., Chula Vista, CA (US) 91911

( * ) Notice: Subject to any disclaimer, the term of this patent is extended or adjusted under 35 U.S.C. 154(b) by 0 days.

(21) Appl. No.: 10/412,572

(22) Filed: Apr. 14, 2003

(51) Int. Cl.[7] ..... H01R 13/60; H01R 13/66

(52) U.S. Cl. ..... 439/535; 439/622

(58) Field of Search ..... 439/535, 536, 439/621, 622; 337/197; 174/53

(56) References Cited

U.S. PATENT DOCUMENTS

| | | | | | |
|---|---|---|---|---|---|
| 2,437,802 | A | * | 3/1948 | Adler | 337/189 |
| 2,636,096 | A | * | 4/1953 | Di Blasi | 337/189 |
| 3,622,840 | A | * | 11/1971 | Kahn | 361/626 |
| 3,707,697 | A | * | 12/1972 | Izumi | 439/107 |
| 3,717,836 | A | | 2/1973 | Humphreys | |
| 3,836,821 | A | | 9/1974 | Wahlgren et al. | |
| 3,922,586 | A | | 11/1975 | Buxton et al. | |
| 4,103,125 | A | | 7/1978 | Marrero | |
| D279,285 | S | | 6/1985 | Schwartz | |
| 5,708,554 | A | | 1/1998 | Liner | |
| 6,049,143 | A | | 4/2000 | Simpson et al. | |

* cited by examiner

*Primary Examiner*—Neil Abrams

(57) ABSTRACT

A power surge protectorant electrical outlet assembly for protecting against power surges and interrupting ground fault circuits in the event of electrical problems including short circuits. The power surge protectorant electrical outlet assembly includes an electrical component support member being adapted to be mounted to a wall of a building structure; and also includes an electrical component assembly including a housing being securely fastened in the electrical component support member and having front and side walls and also having plug-in outlet slots being disposed in and through the front wall and also having fuse receiver slots being disposed in and through the front wall, and also including electrical circuitry being disposed in the housing; and further includes a plate member being fastened upon the front wall of the housing; and also includes adapter plugs each including a plug body having plug jacks being disposed therein, and also including plug prongs being attached to the plug body and being removably received in the plug-in outlet slots of the housing; and further includes a fuse member being removably received in the fuse receiver slots to form a complete circuit with the electrical circuitry; and also includes a face plate being fastened over the plate member and the fuse member.

7 Claims, 4 Drawing Sheets

POWER SURGE PROTECTORANT ELECTRICAL OUTLET ASSEMBLY

BACKGROUND OF THE INVENTION

1. Field of the Invention

The present invention relates to shock-dampening electrical outlets and more particularly pertains to a new power surge protectorant electrical outlet assembly for protecting against power surges and interrupting ground fault circuits in the event of electrical problems including short circuits.

2. Description of the Prior Art

The use of shock-dampening electrical outlets is known in the prior art. More specifically, shock-dampening electrical outlets heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,103,125; U.S. Pat. No. 3,717,836; U.S. Pat. No. 6,049,143; U.S. Pat. No. 3,836,821; U.S. Pat. No. 3,922,586; U.S. Pat. No. 5,708,554; and U.S. Patent No. Des. 279,285.

While these devices fulfill their respective, particular objectives and requirements, the aforementioned patents do not disclose a new power surge protectorant electrical outlet assembly. The prior art includes fuse boxes and electrical outlets with breaker switches but none with fuse members.

SUMMARY OF THE INVENTION

The general purpose of the present invention, which will be described subsequently in greater detail, is to provide a new power surge protectorant electrical outlet assembly which has many of the advantages of the shock-dampening electrical outlets mentioned heretofore and many novel features that result in a new power surge protectorant electrical outlet assembly which is not anticipated, rendered obvious, suggested, or even implied by any of the prior art shock-dampening electrical outlets, either alone or in any combination thereof. The present invention includes an electrical component support member being adapted to be mounted to a wall of a building structure; and also includes an electrical component assembly including a housing being securely fastened in the electrical component support member and having front and side walls and also having plug-in outlet slots being disposed in and through the front wall and also having fuse receiver slots being disposed in and through the front wall, and also including electrical circuitry being disposed in the housing; and further includes a plate member being fastened upon the front wall of the housing; and also includes adapter plugs each including a plug body having plug jacks being disposed therein, and also including plug prongs being attached to the plug body and being removably received in the plug-in outlet slots of the housing; and further includes a fuse member being removably received in the fuse receiver slots to form a complete circuit with the electrical circuitry; and also includes a face plate being fastened over the plate member and the fuse member. None of the prior art includes the combination of the elements of the present invention.

There has thus been outlined, rather broadly, the more important features of the power surge protectorant electrical outlet assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new power surge protectorant electrical outlet assembly which has many of the advantages of the shock-dampening electrical outlets mentioned heretofore and many novel features that result in a new power surge protectorant electrical outlet assembly which is not anticipated, rendered obvious, suggested, or even implied by any of the prior art shock-dampening electrical outlets, either alone or in any combination thereof.

Still another object of the present invention is to provide a new power surge protectorant electrical outlet assembly for protecting against power surges and interrupting ground fault circuits in the event of electrical problems including short circuits.

Still yet another object of the present invention is to provide new power surge protectorant electrical outlet assembly that is easy and convenient to set up and install.

Even still another object of the present invention is to provide a new power surge protectorant electrical outlet assembly that protects electrical equipment and also provides safety to the users using the present invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
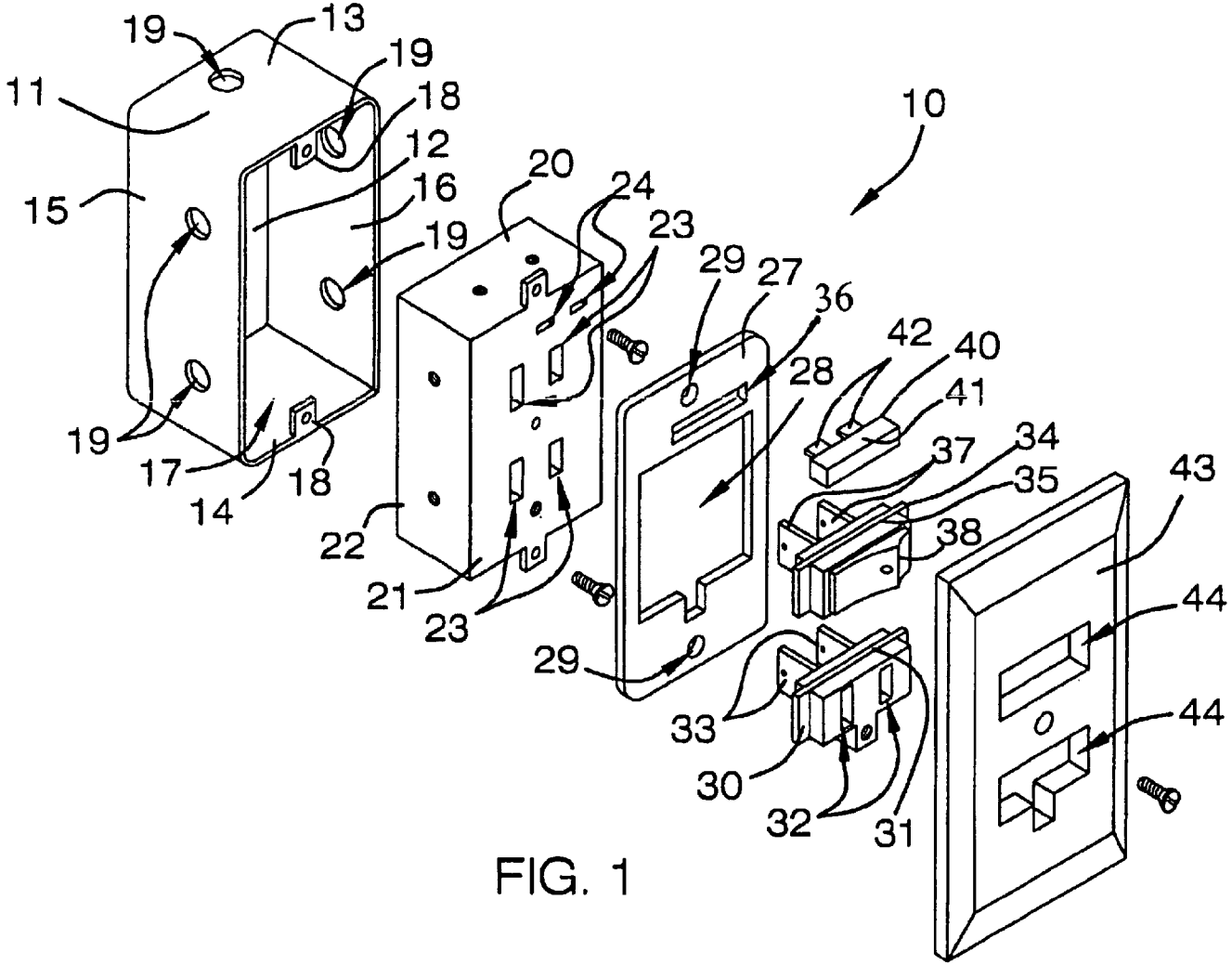
FIG. 1 is an exploded perspective view of a new power surge protectorant electrical outlet assembly according to the present invention.
Figure 2:
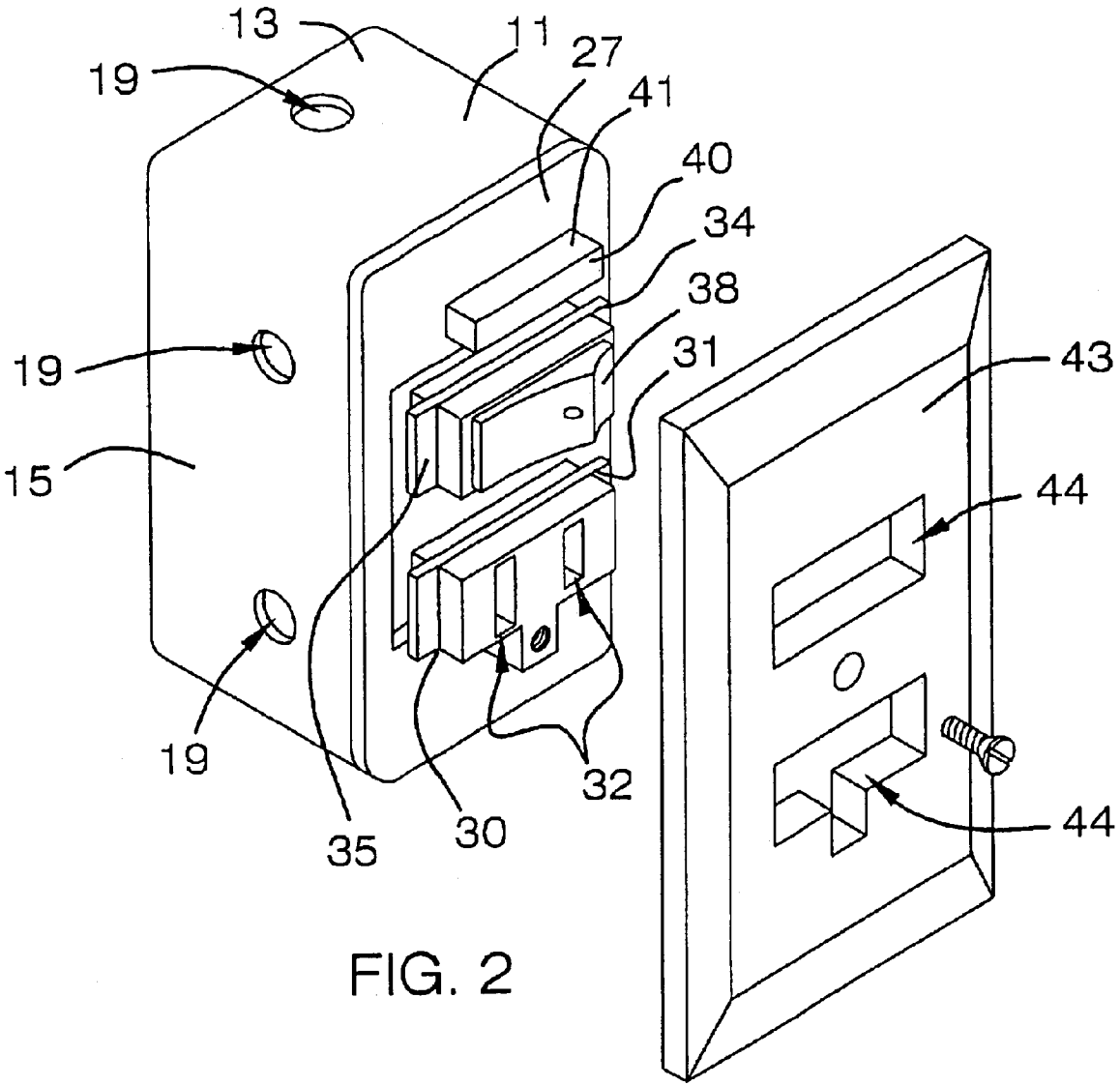
FIG. 2 is a partial exploded perspective view of the present invention.
Figure 3:
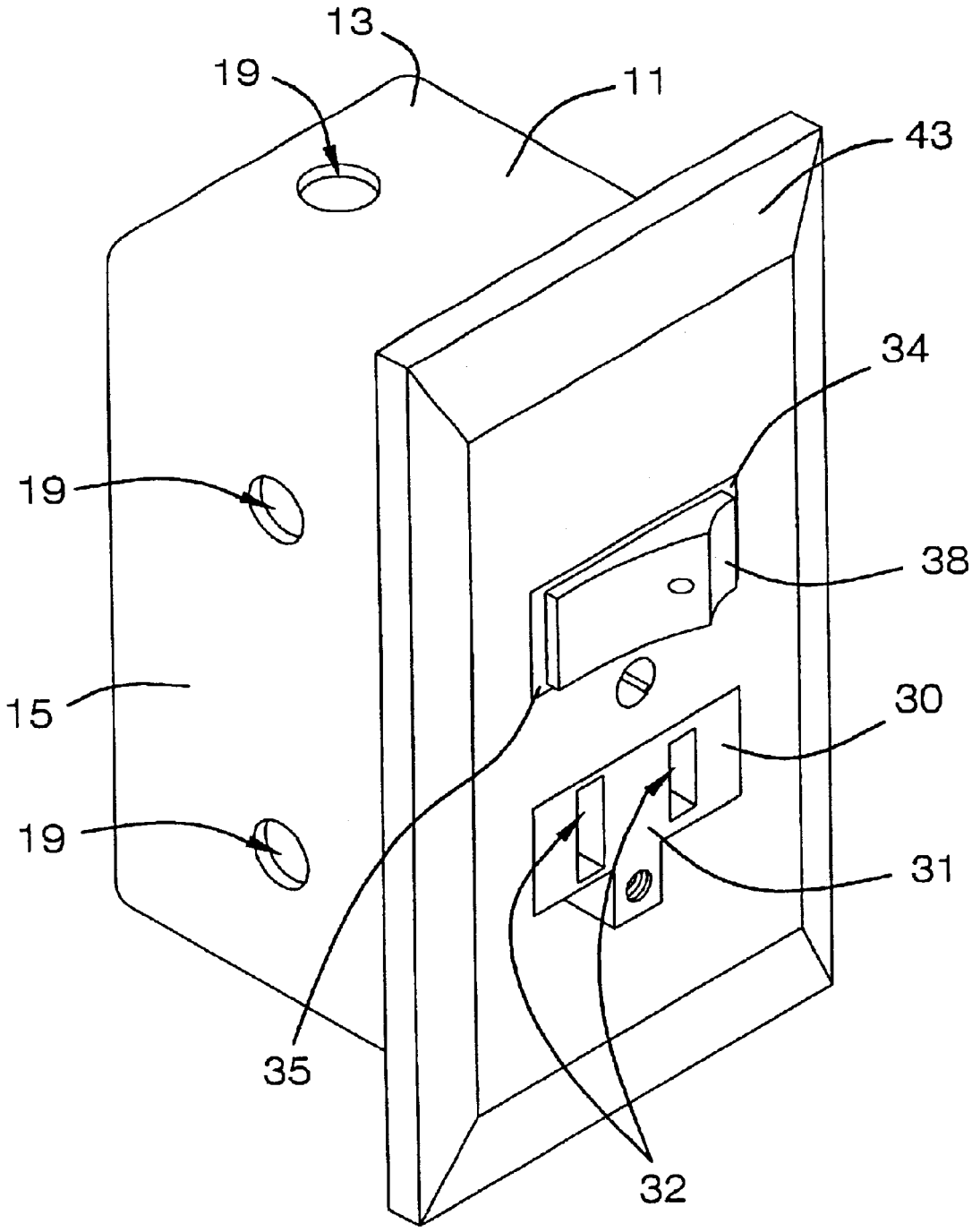
FIG. 3 is a perspective view of the present invention.

With reference now to the drawings, and in particular to FIGS. 1 through 4 thereof, a new power surge protectorant electrical outlet assembly embodying the principles and concepts of the present invention and generally designated by the reference numeral 10 will be described.

As best illustrated in FIGS. 1 through 4, the power surge protectorant electrical outlet assembly 10 generally comprises an electrical component support member 11 being adapted to be mounted to a wall of a building structure. The electrical component support member 11 is generally a box having back, top, bottom, and side walls 12–16 and an open front 17, also having eyelet members 18 being conventionally attached to the top and bottom walls 13, 14 and being disposed inwardly of the box, and further having holes 19 being disposed through the top, bottom and side walls 12–16 for receiving electrical wires therethrough.

Figure 4:
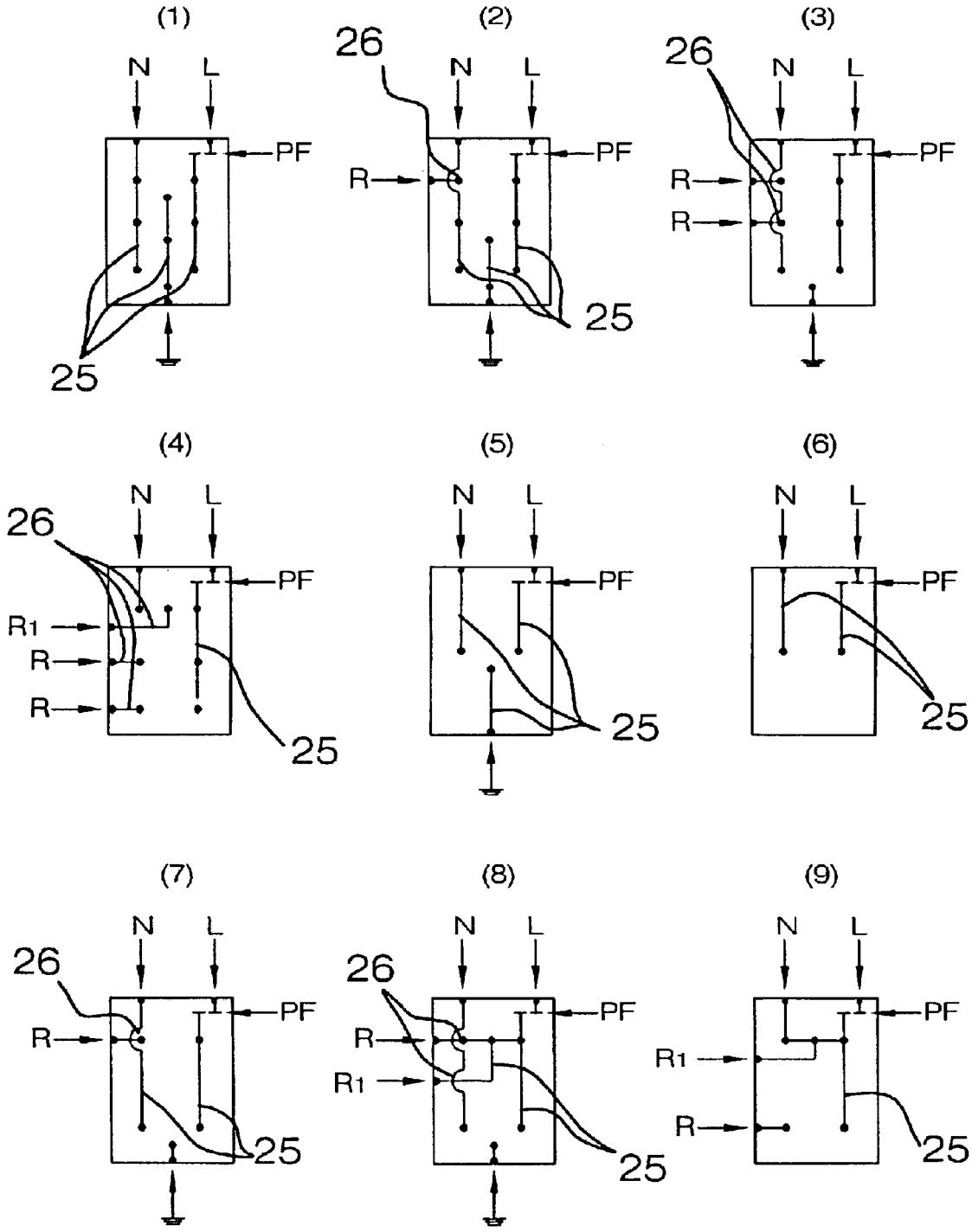
FIG. 4 is a schematic diagram of the various circuitry of the present invention.

An electrical component assembly includes a housing 20 being securely and conventionally fastened in the electrical component support member 11 and having front and side walls 21,22 and also having plug-in outlet slots 23 being disposed in and through the front wall 21 and also having fuse receiver slots 24 being disposed in and through the front wall 21, and also including electrical circuitry 25,26, as shown in FIG. 4, being conventionally disposed in the housing 20. The electrical circuitry 25,26 includes wiring 25 for the plug-in outlets 23 and also includes resistors 26 being conventionally disposed inline of the wiring 25 for dampening flow of electrical current in the electrical component assembly.

A plate member 27 is conventionally fastened upon the front wall 21 of the housing 20. The plate member 27 has an opening 28 being disposed therethrough, and also has mounting holes 29 being disposed near top and bottom edges of the plate member 27, and further has a fuse mounting slot 36 being disposed therethrough.

The power surge protectorant electrical outlet assembly 10 also comprises adapter plugs 30,34 each including a plug body 31,35 with one plug body 31 having plug jacks 32 being disposed therein, and also including plug prongs 33,37 being conventionally attached to the plug body 31,35 and being removably received in the plug-in outlet slots 23 of the housing 20 for connecting to the electrical circuitry 25,26 disposed in the housing 21. Each plug body 31,35 has front and back sides with respective plug jacks 32 being conventionally disposed in the front side of one plug body 30 and with respective plug prong 33,37 being conventionally attached to and extending outwardly from the back side. One of the adapter plugs 34 further includes an on/off switch member 38 being movably and conventionally attached to a respective plug body 35. A fuse member 30 having a fuse body 41 and fuse prongs 42 conventionally attached to the fuse body 41 is removably received in the fuse receiver slots 24 to complete the electrical circuitry 25,26 in the housing 20. A face plate 43 is conventionally fastened over the plate member 27 and the fuse member 40. The face plate 43 includes openings 44 being disposed therethrough and through which front portions of the adapter plugs 30,34 extend.

In use, the user plugs electrical cords of selected electrical equipment into one of the adapter plugs 30,34 for energizing the electrical equipment. The fuse member 40 protects the electrical equipment should there be short circuits or power surges, since it would burn out and break the connection between the power supply and the electrical equipment. The user would simply replace the fuse member 40 with a new one.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the power surge protectorant electrical outlet assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A power surge protectorant electrical outlet assembly comprising:

an electrical component support member being adapted to be mounted to a wall of a building structure;

an electrical component assembly including a housing being securely fastened in said electrical component support member and having front and side walls and also having plug-in outlet slots being disposed in and through said front wall and also having fuse receiver slots being disposed in and through said front wall, and also including electrical circuitry being disposed in said housing;

a plate member being fastened upon said front wall of said housing;

adapter plugs each including a plug body with one said plug body with one said plug body having plug jacks being disposed therein, and also including plug prongs being attached to said plug body and being removably received in said outlet slots of said housing;

a fuse member being removably received in said fuse receiver slots to complete said electrical circuitry in said housing; and a face plate being fastened over said plate member and said fuse member.

2. The power surge protectorant electrical outlet assembly as described in claim 1, wherein said electrical component support member is generally a box having back, top, bottom, and side walls and an open front, also having eyelet members being attached to said top and bottom walls and being disposed inwardly of said box, and further having holes being disposed through said top, bottom and side walls for receiving electrical wires therethrough.

3. The power surge protectorant electrical outlet assembly as described in claim 2, wherein said plate member has an opening being disposed therethrough, and also has mounting holes being disposed near top and bottom edges of said plate member, and further has a fuse mounting slot being disposed therethrough.

4. The power surge protectorant electrical outlet assembly as described in claim 3, wherein each said plug body has front and back sides with a respective said plug jacks being disposed in said front side of one said plug body and with a respective said plug prongs being attached to and extending outwardly from said back side.

5. The power surge protectorant electrical outlet assembly as described in claim 4, wherein one of said adapter plugs further includes an on/off switch member being movably attached to a respective said plug body.

6. The power surge protectorant electrical outlet assembly as described in claim 5, wherein said face plate includes openings being disposed therethrough and through which front portions of said adapter plugs extend.

7. The power surge protectorant electrical outlet assembly as described in claim 6, wherein said electrical circuitry includes wiring for a plurality of said plug-in outlets and also includes resistors being disposed inline of said wiring for dampening flow of electrical current in said electrical component assembly.

* * * * *